US005691903A

United States Patent [19]

Racette, III

[11] Patent Number: 5,691,903

[45] Date of Patent: Nov. 25, 1997

[54] INTEGRATED CABLE NAVIGATION AND CONTROL SYSTEM

[75] Inventor: Russell A. Racette, III, Newport, R.I.

[73] Assignee: The United States of America as represented by the Secretary of the Navy, Washington, D.C.

[21] Appl. No.: 525,803

[22] Filed: Sep. 8, 1995

[51] Int. Cl.[6] ..... G06F 165/00; F16F 1/00

[52] U.S. Cl. ..... 364/449.1; 364/449.7; 405/158; 405/166

[58] Field of Search ..... 364/443, 449.1, 364/449.7; 405/154, 158, 160, 166, 167, 168.3, 168.4

[56] References Cited

U.S. PATENT DOCUMENTS

| | | | |
|---|---|---|---|
| 3,576,977 | 5/1971 | Kolb | 405/158 |
| 3,668,878 | 6/1972 | Jones et al. | 405/168.4 |
| 4,120,167 | 10/1978 | Denman et al. | 405/166 |
| 4,164,379 | 8/1979 | Denman | 405/158 |
| 4,238,824 | 12/1980 | DeMatte et al. | 364/449.1 |
| 4,755,947 | 7/1988 | Braschler et al. | 405/158 |
| 5,000,619 | 3/1991 | Kordahi | 405/166 |

*Primary Examiner*—Gary Chin
*Attorney, Agent, or Firm*—Michael J. McGowan; William F. Eipert; Prithvi C. Lall

[57] ABSTRACT

A system for accurate guidance of a vessel and precise deployment of undersea cable or pipe includes cable control sensors for monitoring cable length, payout rate, and cable tension; navigation sensors for monitoring vessel position, heading, and speed; and environmental sensors for monitoring the water depth and current profile. A cable navigation control processor uses data collected by the cable control sensors, navigation sensors, and environmental sensors and compares this data with a predetermined cable payout plan to compute the ideal vessel heading and speed and the appropriate cable payout rate.

11 Claims, 2 Drawing Sheets

INTEGRATED CABLE NAVIGATION AND CONTROL SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a system for planning and precisely executing offshore cable laying operations. More specifically, the present invention relates to a system for accurate guidance of a vessel and deployment of cable in undersea cable laying operations.

(2) Description of the Prior Art

Conventional systems for planning and executing undersea pipe or cable laying operations typically rely upon driving a vessel on the desired predetermined track of the cable or pipe. The cable is deployed off the stern of the vessel and is expected to fall in approximately the path followed by the vessel. However, water currents and wave action can have a great impact upon the point at which the cable touches the sea floor. Additionally, when the cable is being laid on a curved path the point at which the cable touches the sea bed will deviate from the vessel path.

To compensate for curves in the cable path and for water currents, pipe and cable laying vessels often employ a towed device to monitor the position of the cable on the sea floor. Based on the position information, the vessel can modify its current course to control the placement of the cable. Alternatively, the tension on the pipe or cable as it exits the vessel is measured and used to compute a vessel course which will place the cable at the proper point on the sea bed.

While these conventional techniques enable guidance of a vessel to deploy pipe or cable along a predetermined path, they suffer from several disadvantages which can limit their use for some applications. The use of a second vessel to deploy the towed device to monitor the touchdown point of the cable greatly increases the cost of deploying the cable. Using a towed device deployed from the cable laying vessel eliminates the costs associated with the second vessel. However, this method requires that the cable or pipe deployed contain a transducer to emit a signal which can be used to track the pipe or cable.

The use of cable tension to position the vessel limits the size and weight of the cable deployed. Cable placement can be greatly affected by currents. Lighter cables can greatly deviate from the desired track without producing a significant change in the tension on the cable. Therefore, systems relying on cable tension typically require heavy cables which tend to produce a large amount or a significant change in tension on the cable.

Thus, what is needed is a system for planning and executing offshore cable laying operations which provides for accurate guidance of the deployment vessel and accurate placement of the cable without requiring additional vessels to monitor the placement of the cable or relying on significant changes in cable tension measurements.

SUMMARY OF THE INVENTION

Accordingly, it is a general purpose and object of the present invention to provide a system for accurate guidance of a cable or pipe deployment vessel.

Another object of the present invention is to provide a system for accurate deployment and placement of undersea pipe or cable.

A further object of the present invention is the provision of a system for accurate guidance of a vessel and deployment of cable in undersea cable laying operations that does require a second vessel to monitor cable placement.

Yet another object of the present invention is the provision of a system for accurate guidance of a vessel and deployment of cable in undersea cable laying operations that does not rely on cable tension measurements.

These and other objects made apparent hereinafter are accomplished with the present invention by providing a system to aid in navigating a vessel used in laying undersea pipe or cable. The system is designed to provide information regarding vessel position, heading, and speed to a navigator or helmsman and information regarding cable or pipe payout rate to a payout operator to enable accurate placement of undersea pipe and cable. The system includes cable control sensors for monitoring cable length, payout rate, and cable tension; navigation sensors for monitoring vessel position, heading, and speed; and environmental sensors for monitoring the water depth and current profile. A cable navigation and control processor uses data collected by the cable control sensors, navigation sensors, and environmental sensors and compares this data with a predetermined cable payout plan to compute the ideal vessel heading and speed and the appropriate cable payout rate.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE PREFERRED EMBODIMENT

The present invention provides a system to aid in navigating a vessel used in laying undersea pipe or cable. The system can be used to collect survey data including water depth, bottom profiles, and average current speed and direction to aid in determining a suitable course to follow while laying the cable. During cable deployment, the system is designed to provide information regarding vessel position, heading, and speed to a navigator or the helm and information regarding cable or pipe payout rate to a payout operator to enable accurate placement of undersea pipe and cable.

Figure 1:
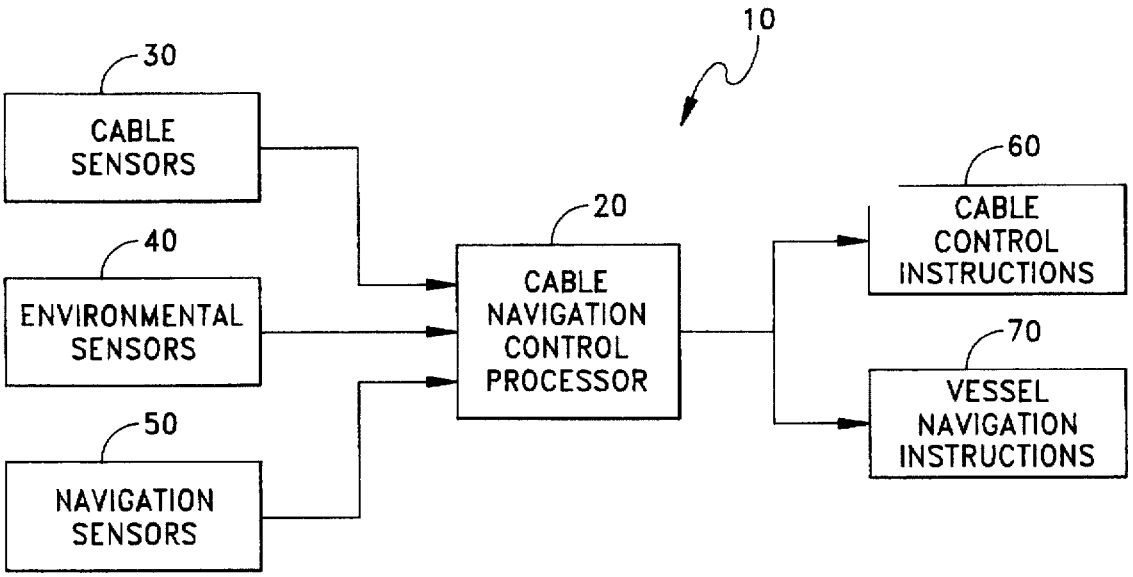
FIG. 1 is a block diagram of an integrated cable navigation and control system in accordance with the present invention.

Referring now to FIG. 1, there is shown a block diagram of an Integrated Cable Navigation and Control System (ICNCS) 10 in accordance with the present invention. A Cable Navigation Control Processor (CNCP) 20 collects cable payout speed and payout length acquired by cable control sensor 30, water depth and current data acquired by environmental sensor 40, and vessel position data acquired by navigation sensor 50. CNCP 20 uses the data from sensors 30, 40, and 50 along with a predetermined cable payout plan stored in CNCP 20, to compute the ideal vessel heading and speed and the cable payout rate. CNCP 20 formats ideal ship heading and speed and cable payout rate data and outputs selected data as cable control instructions 60 or as vessel navigation instructions 70.

Cable control instructions 60 can be outputted to a display device (not shown) associated with a system operator managing CNCP 20, transmitted to a cable control operator either electronically or verbally, or any combination thereof. Similarly, vessel navigation instructions 70 can be passed to the helm or a navigator verbally and/or electronically.

Figure 2:
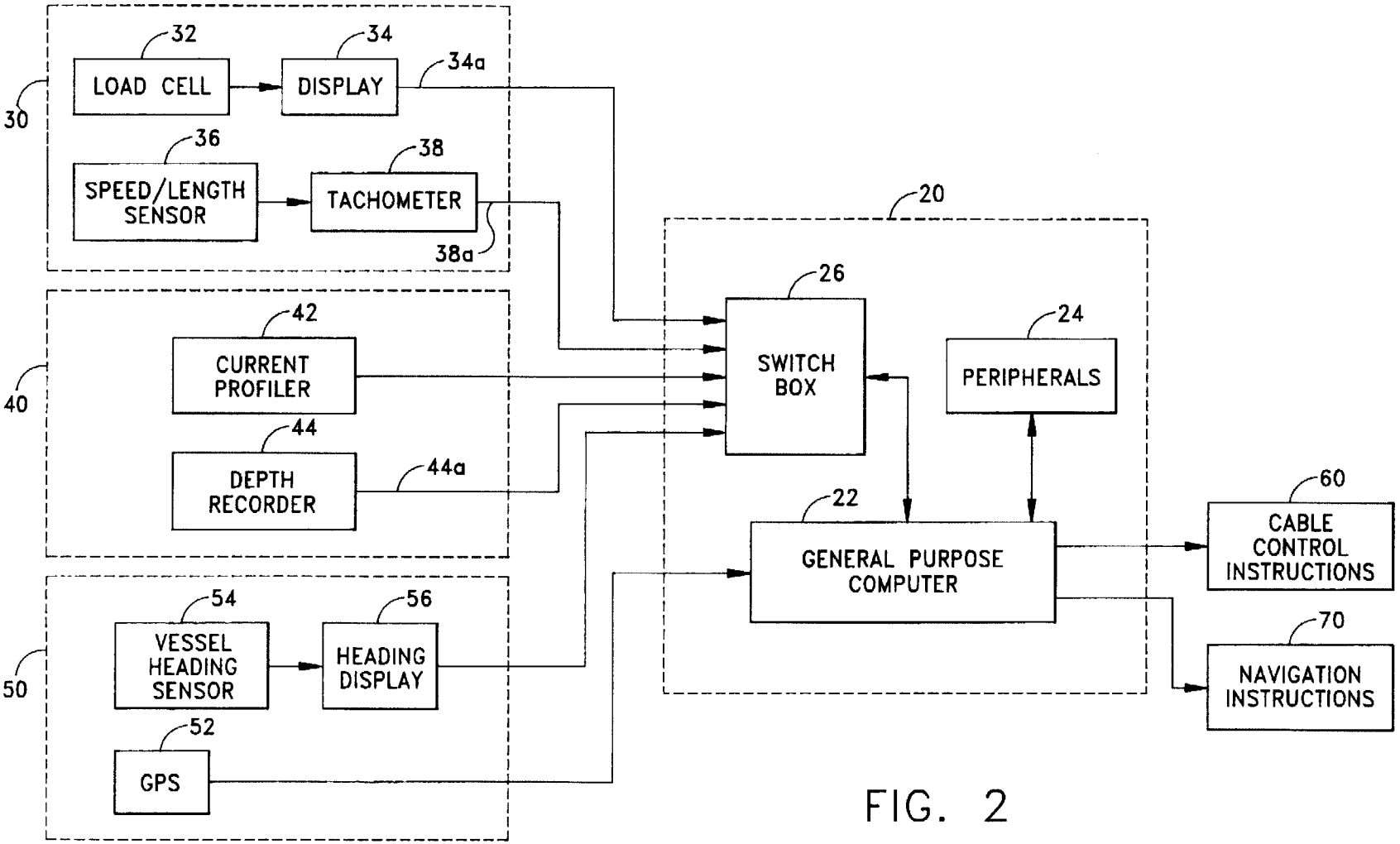
FIG. 2 illustrates an embodiment of the integrated cable navigation and control system of the present invention.

The present invention is shown more particularly in FIG. 2, in which is shown a schematic diagram of an embodiment of an ICNCS 10. In FIG. 2, cable control sensor 30 comprises a load cell 32 or similar device for measuring the downward tension on the cable being deployed and an associated display unit 34 for monitoring the operation of the load cell. Additionally, a cable speed/length sensor 36 such as an optical shaft encoder, a magnetic pickup sensor or the like is installed on the cable payout engine to measure the cable payout speed and the length of the cable deployed. Sensor 36 has an associated display 38 such as a tachometer installed in the vicinity of the cable payout engine operator for readout.

Optical shaft encoders operate by accumulating pulses related to the unit of length being measured. The encoder typically includes a optical source such as a solid state light, emitting diode, an optical sensor such as a silicon cell, and an integrated circuit to provide output signals in a variety of square wave forms compatible with conventional electronic logic. The shaft encoder is connected directly to the shaft of the payout engine and, for each revolution of the shaft, generates a constant number of pulses. The optical encoder counts the number of pulses and produces an output signal indicating the payout speed of the cable.

Magnetic pickup sensors operate by sensing motion of ferrous (magnetic) material targets (gear teeth, boltheads, keyways, etc.) that produce fluctuations in the magnetic flux-field of the pickup as they pass. The resulting signal voltage is directly proportional to the speed of the passing targets. Magnetic pickups are good at moderate-to-high speeds for sensing speed applications. At low speeds the signal level drops below the counter-input threshold, resulting in possible loss of counts.

Either an optical shaft encoder, a magnetic pickup sensor or a combination thereof can be installed to fit a selected application. The specific application depends on the type of cable engine and data requirements. Additionally, depending on the type of sensor employed, additional equipment such as a tachometer 38 to display the cable payout speed and a serial output (RS232) to current loop converter to convert the tachometer output to a serial output signal 38*a* which is compatible with CNCP 20 may be required.

Compression load cell 32 is instrumented either on the cable payout engine or on a cable overboard chute. This sensor measures the downward tension on the cable. A remote display 34 monitors operation of the load cell. Display unit 34 generates an output 34*a* containing cable tension data which is directed to CNCP 20. Cable tension is not needed to for CNCP 20 to generate navigation or cable control instructions. Cable tension is monitored to ensure it does not exceed the rated tension. Excessive cable tension may indicate that the cable is snagged on the bottom.

Environmental sensors 40 acquire water data such as depth or current speed and direction. Sensors 40 comprise a current profiler 42 and a precision depth recorder (PDR) 44, both of which provide output data to CNCP 20. Current profiler 42 supplies current speed and direction data and PDR 44 provides water depth output data. PDRs operate on the principle of echo sounding, which is based on the accurate measurement of time required for an acoustic pulse to be transmitted, reflected from the bottom, and return to the receiver. A conventional PDR having a serial output 44*a* can be used to supply depth data to CNCP 20.

Current profiler 42 which can be an Acoustic Doppler Current Profiler (ADCP), an expendable current profiler (XCP) or the like provides real-time current profile data to CNCP 20. These current profiles aid in planning the cable payout and vessel course. The use of current profiler 42 during cable deployment allows updating the cable payout and vessel course plans and provides for more intelligent decision-making should problem situations arise. The current acting on the cable is an important parameter affecting the placement accuracy of the cable. Currents can significantly affect the cable slack and induce cable tensions which, in turn, can drag the cable already laid on the bottom.

An ADCP consists of a transducer mounted to a pole attached to the vessel. The transducer is hard-wired to an acquisition system and operated with a personal computer. During operation of the ADCP, the transducer transmits sound bursts into the water. Particles carried by the water currents scatter the sound back to the transducer, which is listening for this echo. As echoes return from areas deeper in the water column, the transducer assigns different water depths to corresponding parts of the echo record. This assignment allows for the generation of vertical profiles. Motion of particles in the water relative to the transducer causes the echo to change in frequency. The change is measured as a function of depth to obtain water velocity through the water column.

An XCP is a stand-alone system having buoy/probe device, a processor unit and a personal computer which can be shared with an ADCP. An XCP buoy/probe is hand-deployed into the water. The probe is released from the buoy and falls through the water column. As the probe falls through the water column, raw data is sent to the buoy and transmitted via radio frequency from the buoy to a shipboard data acquisition system (processor). The XCP measures a weak electric current generated by the motion of sea water through the earth's magnetic field. The XCP interrupts this magnetically induced current and measures the created electric potential, which is interpreted as relative current velocity and direction.

Navigation sensor 50 acquires vessel navigation data including vessel position and vessel heading. A Global Positioning System (GPS) based device 52 or the like can be used to acquire vessel position data. Vessel heading data can be obtained from the difference of consecutive position points. Alternatively, a vessel heading sensor 54 such as a magnetic electronic fluxgate compass, a digital gyrocompass, or the like can be used to provide instantaneous vessel heading data to CNCP 20. Additionally, a heading display 56 can be used to display vessel heading data to a navigator.

Positioning device 52 receives vessel position data from the GPS satellite network. Device 52 can provide serial output data directly to CNCP 20 or through a personal computer connected to the device. Device 52 displays and transmits vessel position data in a user-chosen format such as latitude and longitude or range coordinates. The GPS positioning data can be corrected to provide greater accuracy of vessel position by employing conventional differential techniques such as a Coast Guard differential GPS correction radio which beacons from Coast Guard stations, a local high frequency transmission system broadcast from a surveyed land base, or a leased commercial satellite system. In a preferred embodiment, a leased commercial satellite service, which is available worldwide, is used to accurately position the vessel.

The use of either a magnetic electronic fluxgate compass or a gyrocompass allows serial output of vessel heading data to CNCP 20. A magnetic electronic fluxgate compass continuously measures the vessel's magnetic deviation and automatically compensates itself to a ±0.5 degree accuracy. If something significantly alters the vessel's magnetic deviation, the compass will automatically gather new data as the vessel turns and recompensate itself to ensure accuracy for the new conditions. While the compass provides a variety of data such as bearing to next waypoint, distance to go, etc., only heading data need be sent to CNCP 20. When using a gyrocompass, a digital gyro repeater can be used to interface with the main gyro of the vessel. This repeater decodes the gyro transmission signal, displays heading data and analog turning information, and provides a serial output to CNCP 20.

CNCP 20 comprises a general purpose computer 22, peripheral devices 24, and a switch box 26. General purpose computer 22 which can be a microprocessor based computer, a UNIX workstation, or the like receives all the data collected by cable control sensors 30, environmental sensors 40, and navigation sensors 50, compares the data with a predetermined cable payout plan, and computes the ideal vessel heading and speed and the cable payout rate. Computer 22 formats ideal ship heading and speed and cable payout rate data and transmits the data as cable control instructions 60 or as vessel navigation instructions 70. The operation of computer 22 is explained in more detail in reference to FIG. 3.

Peripheral devices 24 can comprise any of several conventional devices such as external hard disks, printers, or the like to provide the capability to record sensor data, cable control and navigation instructions, and any system messages during cable deployment. Peripherals 24 can also provide the ability to playback stored data.

Switch box 26 receives measured data from navigation sensors, environmental sensors and cable control sensors, performs any necessary data conversion, and generates a single multiplexed input data stream which is sent to computer 22. In a preferred embodiment, each sensor provides data over a standard serial (RS232) connection and switch box 26 is simply used to increase the number of available serial ports available to computer 22. In such an embodiment, switch box 26 can comprise any of several conventional multiplexers or shared communication devices. If computer 22 contains enough serial ports the sensors can be directly connected to computer 22, thereby eliminating the need for data acquisition processor 26. However, it is often desirable to have redundant sensors and switch box 26 provides the ability to quickly and easily choose which sensor output data to direct to transmit to computer 22 for processing. Similarly, switch box 26 can comprise one or more workstations, each being connected to one or more sensors, which communicate with computer 22 through ethernet using transmission control protocol/internet protocol (TCP/IP) or through a similar communication means.

Cable control instructions 60 can be outputted to a display device (not shown) associated with computer 22 and transmitted to a cable control operator either verbally or electronically by a system operator monitoring computer 22. Optionally, instructions 60 can be sent to a cable control workstation monitored by a cable payout operator. Similarly, vessel navigation instructions 70 can be sent to a display device associated with computer 22 and passed to the helm or a navigator verbally and/or electronically. Preferably, instructions 70 are transmitted to a navigation workstation with a display device located in the helm. The cable control workstation and navigation workstation can be connected to computer 22 using conventional means such as through ethernet using TCP/IP or similar communication means.

Figure 3:
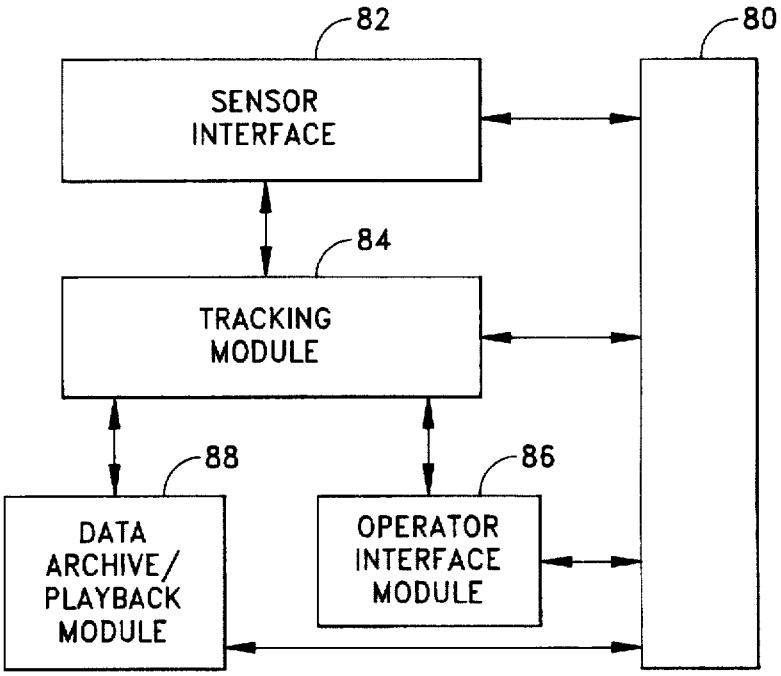
FIG. 3 is a block diagram of the functional units for an integrated cable navigation and control processor.

Referring now to FIG. 3, there is shown a block diagram of the functional units for an integrated cable navigation control processor in accordance with the present invention. In FIG. 3, a system executive module 80 controls and coordinates data transfers between and the data processing functions across sensor interface module 82, tracking module 84, operator interface module 86, and data archive/playback module 88.

Sensor interface module 82 is responsible for reading data from each serial port connected to an environmental, navigation or cable control sensor, formatting the data for use by tracking module 84, and sending the data to module 84.

Tracking module 84 is responsible for receiving all the data collected and formatted by sensor interface module 82. Module 84 is also responsible for interpreting all the sensor data to generate the ideal vessel heading and speed data and the desired cable payout data. Module 84 operates on the navigation sensor data by performing least-squares filtering on the GPS device 52 positional data to provide a smooth vehicle track. Module 84 uses this smoothed track along with data from vessel heading sensor 54 to calculate vessel course and speed. Vessel course and speed can be obtained from the difference between two GPS coordinate readings to accurately determine the vessel's true course and speed.

Module 84 collects environmental and cable control data to determine the current cable payout rate, the actual cable length onboard and payed out, and the undersea cable position. Module 84 compares these values with planned values from the cable payout table and computes cable navigation data such as along and across track errors, range and time to next waypoint, ideal payout rate, and the ideal vessel position, heading, speed, and course given the cable laying course and geometry. Module 84 also formats the cable navigation data and separates the data into either cable control instructions or navigation instructions.

Operator interface module 86 is responsible for reading the cable control instructions and navigation instructions generated by module 84 and displaying the instructions along with any system status or error messages at the appropriate workstation. Module 84 is responsible for receiving all system message packets off the ethernet, formatting data and instructions into system message packets, and sending the data out over the ethernet.

Module 86 can format the cable control instructions and navigation instructions to provide alphanumeric and/or geographic display formats of cable control and navigation parameters computed by tracking module 84. A geographic display format provides a visual representation of both true and ideal vehicle tracks overlaid on a map of the operation site, along with individual control of all tracks' display parameters (i.e., track length, time-tic display, vehicle color, etc.). The geographic display also provides tools for displaying range and bearing from one point to another, fixed points, vehicle position in latitude/longitude, range coordinates and, if necessary, for sending a modification of the cable length value. The alphanumeric displays provide the operator with positional and cable navigation data can be manipulated to suit the dictates of the operation.

Data archive/playback module 88 is responsible for collecting data for analysis after the cable deployment operation has been completed. This data can include raw cable control, environmental or navigational data, instructions, system messages, or operator inputs. Module 88 stores the selected data onto a tape or into a file on a hard disk. Module 88 also provides the ability to read the data from a tape or disk file to re-enact the deployment or for use in training operators.

In operation, a cable payout table is generated and stored in computer 22. The payout table provides for planning the cable-route waypoints, the amount of cable slack required, and the cable-payout rate. The objective of the table is to determine the following parameters: (1) surface coordinate with deployment slack and cable fill in X- and Y-range coordinates, (2) desired vessel speed, (3) desired cable engine payout rate, and (4) quantity of cable payout required. These four parameters can be computed directly on computer 22 or on a personal computer and input to ICNCS 10 via an electronic media device or TCP/IP.

There are three steps in creating these four parameters. First, the cable length intervals are input in a column of the payout table. Next, the user-chosen cumulative change in course for a desired geometry (final cable position) is input into a column. From the length interval column and the desired geometry column the surface coordinates without cable slack adjustments are computed, completing step 1. The second step is to input the user-desired deployment slack in a column. Computing new surface coordinates with deployment slack finishes step 2. The final step is to input the ocean-water depth along the desired cable geometry. With this final input the table computes the cable fill and fractional accuracies from conventional cable mechanics equations, and then solves and creates a file of the four desired parameters.

The first two steps of the payout table can be completed prior to departing for sea. The third step requires collecting the bathymetric and water-current speed data. These data are collected during a sea trial exercise. The sea trial involves maneuvering the vessel along the cable geometry per the payout table with coordinates, determined during step 2, while all equipment is checked for proper operation. Once the bathymetric and water current speed data are collected, the data is input into the payout table and the final vessel course and payout rates are computed.

Having derived the cable payout table, the cable deployment operation begins. As the vessel begins to deploy cable, the cable control, environmental, and navigation sensors continuously collect data which is sent to computer 22. Computer 22 compares the data to the cable payout table and generates cable control and navigation instructions. The cable control and navigation instructions generated by computer 22 are transmitted to the vessel navigator and cable control operator. The navigator and cable control operator use the instructions to control the vessel's course and to operate the cable payout equipment. Alternatively, the navigation instructions generated by computer 22 can be sent directly to the vessel's navigation control system to allow automated computer control of the vessel's course, heading, and speed. Similarly, the cable control instructions can be electronically supplied to the cable payout engine to allow for automated control.

In operation, computer 22 also monitors the collected sensor data to determine whether to update the cable payout table. When the environmental data previously used to generate the planned vessel course and speed and the payout rates contained in the cable payout differ form the current readings by a certain percentage, such as 15–20%, computer 22 may automatically update the cable payout table or signal an operator to initiate a rebuild of the cable payout table.

Thus, what has been described is a system for accurate guidance of a vessel and deployment of cable in undersea cable laying operations that offers several significant advantages over prior art systems. It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for accurate guidance of a vessel and precise deployment of cable comprising:

cable sensor means for monitoring cable payout speed;

environmental sensor means for acquiring water data;

navigation sensor means for acquiring vessel navigation data; and a cable navigation control processor, responsive to said cable sensor means, to said environmental sensor means and to said navigation sensor means, for generating vessel navigation instructions and cable control instructions.

2. The system of claim 1 wherein said environmental sensor means comprises a depth recorder for monitoring water depth and a current profiler for monitoring current speed and direction.

3. The system of claim 2 wherein said cable navigation control processor compares the data acquired by said cable sensor means, said environmental sensor means and said navigation sensor means with a predetermined cable payout plan to generate said vessel navigation instructions and said cable control instructions.

4. The system of claim 3 wherein said cable navigation control processor comprises a general purpose microprocessor based computer.

5. The system of claim 4 wherein said navigation sensor means is responsive to a satellite orbiting the earth and acquires vessel position with reference to said satellite.

6. The system of claim 5 wherein said predetermined cable payout plan includes data indicating desired vessel surface coordinates, desired vessel speed, desired cable payout rate, and quantity of cable payout required.

7. The system of claim 6 further including data storage means, connected to said cable navigation control processor, for recording the data acquired by said cable sensor means, said environmental sensor means and said navigation sensor means and for recording said vessel navigation instructions and said cable control instructions.

8. The system of claim 1 wherein said cable navigation control processor comprises a general purpose microprocessor based computer.

9. The system of claim 8 wherein said cable navigation control processor receives system data acquired by said cable sensor means, said environmental sensor means and said navigation sensor means, and compares the acquired system data with cable payout data to generate said vessel navigation instructions and said cable control instructions.

10. The system of claim 9 wherein said cable payout data comprises desired vessel surface coordinates, desired vessel speed data, and desired cable payout rate data.

11. The system of claim 10 wherein said vessel navigation instructions comprises ideal vessel heading data and ideal vessel speed data.

* * * * *